United States Patent [19]

Suzuki

[11] 3,985,482

[45] Oct. 12, 1976

[54] DEVICE FOR PRODUCING PRESTRESSED CONCRETE MEMBER

[75] Inventor: Shigeru Suzuki, Fuchu, Japan

[73] Assignee: Nihon Kogen Concrete Kabushiki Kaisha, Japan

[22] Filed: Feb. 25, 1975

[21] Appl. No.: 553,044

[30] Foreign Application Priority Data

June 11, 1974 Japan ..... 49-66878

[52] U.S. Cl. ..... 425/111; 249/94; 249/97

[51] Int. Cl.[2] ..... B28B 21/60

[58] Field of Search ..... 425/111; 264/228–229; 249/91, 93–94, 96–97

[56] References Cited

UNITED STATES PATENTS

| | | | |
|---|---|---|---|
| 2,535,100 | 12/1950 | Sourwine | 264/228 |
| 2,695,754 | 11/1954 | Karig | 249/96 |

FOREIGN PATENTS OR APPLICATIONS

| | | | |
|---|---|---|---|
| 1,162,106 | 9/1958 | France | 249/93 |
| 1,210,793 | 10/1970 | United Kingdom | 264/228 |

*Primary Examiner*—Robert D. Baldwin
*Assistant Examiner*—John McQuade
*Attorney, Agent, or Firm*—Ladas, Parry, Von Gehr, Goldsmith & Deschamps

[57] ABSTRACT

A device for producing a prestressed concrete member adapted to facilitate the joining of one concrete member to another including a mold having a plurality of panels oppositely disposed, one of the panels being provided with a plurality of fixing metal pieces each having a concaved portion in the top surface thereof, another panel of said panels being provided with cup-shaped guide metal pieces at the corresponding positions to said fixing metal pieces, an anchor plate fixedly disposed transversely and adjacently to the top portions of said fixing metal pieces, tensioning steel members coated with an sliding material each having one end connected with said anchor plate and the other end pierced through the top portion of said guide metal piece into the inside of said guide metal piece, one end of tension steel members each having a head portion for engaging with said anchor plate or the projecting portion formed therein in the shape of a crater so as to be fitted in said concaved portion of said fixing metal piece, the anchor plate being securely clamped to said one panel at a predetermined portion thereof by means of a bolt, the other ends of said tensioning steel members in said guide metal pieces being strained by a tension applying means after the concrete that is poured in said mold is hardened, and being clamped by a nut, whereby prestress is introduced into the concrete.

13 Claims, 8 Drawing Figures

DEVICE FOR PRODUCING PRESTRESSED CONCRETE MEMBER

BACKGROUND OF THE INVENTION

This invention relates to a device for producing prestressed concrete members, such as concrete cross ties, concrete piles, concrete boards, according to the post-tensioning method.

Hitherto, for introducing a prestress into a precast concrete member according to the post-tensioning method, the end of a tensioning steel member is fastened to an anchor plate placed adjacent to the end surface of a concrete member to be formed. However, this method suffers from disadvantages in that the edges or ends of an anchor plate and tensioning steel member are exposed from the surface of a concrete member, so that there are experienced some difficulties in stopping the ingress of water through the joint of one concrete member to another, in addition, this concrete member involves an appearance problem.

Furthermore, when a tensioning member is fastened to an anchor plate with nuts at its opposite ends, a tension applied to the tensioning member is received by the male and female screw threads of tensioning steel and nuts, respectively, which are in meshing relation, and, as a result, there is created gaps between the screw threads, so that there is a danger of embrittlement cracking in the abutting or meshing portions of the both male and female threads, or there results in loosened engagement of a tensioning steel member with nuts, thus lowering the tension being applied thereto.

In addition, according to the conventional post-tensioning method, antifriction agent or sliding material such as water glass or asphalt is applied to the mid portion of a tensioning steel wire or bar, and the steel wire or bar is buried in a concrete so that the tensioning member is isolated from the concrete surrounding same, thus preventing local concentration of a prestress, when the prestress is introduced to a concrete member. However, this still fails to meet the success, because water glass or asphalt is apt to adhere to hands, molds or other members when placing steel wires or bars in a mold, so that the concrete is peeled from such members due to the adhesion of the sliding material or antifriction material. In addition, water glass or asphalt may possibly be included into concrete. For avoiding this shortcoming, vinyl tape or the like is wound around a steel wire or bar, to which has been applied water glass or asphalt. This apparently results in increase in expense and man hours and thus is not economical.

SUMMARY OF THE INVENTION

It is accordingly an object of the present invention to provide a device for producing a concrete member, in which ends of a tensioning member and anchor plate are completely buried in a concrete member, thus facilitating the joining of one concrete member to another for the purposes of stopping water from leaking through the joint of the two adjoining concrete members, while presenting good appearance.

It is another object of the present invention to provide a device for producing a concrete member, in which the sliding or antifriction material to be applied to a tensioning steel member will not adhere to hands or other members in assembling a mold, placing steel bars in concrete or pouring concrete in a mold, thus preventing peeling between concrete and other members, and in which the sliding material may serve as an antifriction agent for a tensioning steel member, when a prestress is introduced to the steel member.

It is a further object of the present invention to provide a device for producing a concrete member, in which a tensioning steel member may be accurately positioned by a simple operation, and yet is not displaced due to the pouring of concrete, while permitting the positive introduction of a prestress.

It is still a further object of the present invention to provide a device for producing a concrete member, in which the introduction of a prestress will not be hindered due to loosened nuts.

It is a yet further object of the present invention to provide a device for producing a concrete member, which device prevents embrittlement cracking of screw threads by eliminating the concentration of load on the mutually abutting or meshing portions of screw threads due to the presence of adhesive filled in voids or gaps defined between the screw threads of nuts and tensioning steel members.

It is a further object of the present invention to provide a device for producing a concrete member, which device permits the production of a concrete member at a high accuracy without deforming stacked molds, while saving the space for molds to be set up by stacking one mold on top of another in molding and curing operation.

According to the present invention, there is provided a device for producing a concrete member which can be used in a method comprising the steps of:

inserting the threaded portion of a tensioning steel member into a guide metal piece of a cylindrical shape and having inwardly projecting top surface, said tensioning steel member having at the other end an anchor plate secured thereon, and said guide metal piece being formed on one of opposing panels of a mold in inwardly projecting relation;

holding said anchor plate secured to said tensioning steel member in contact with the top or innermost surface of said guide metal piece tightly;

placing said anchor plate in a manner to face a fixing metal piece inwardly projecting from the inner surface of a penal opposing to said one panel;

fastening said anchor plate to said the other panel with a bolt to thereby set said anchor plate on the top or innermost surface of said fixing metal piece;

threading a nut member on the threaded portion of said tensioning steel member;

placing a concrete in a mold in the condition thus defined; and removing said panels from the concrete member hardened, together with said guide metal piece and fixing metal piece;

whereby a prestress is introduced to said tensioning steel member and then a nut is tightened to fix said tensioning steel member in tensioned condition.

DESCRIPTION OF THE PREFERRED EMBODIMENTS

Figure 1:
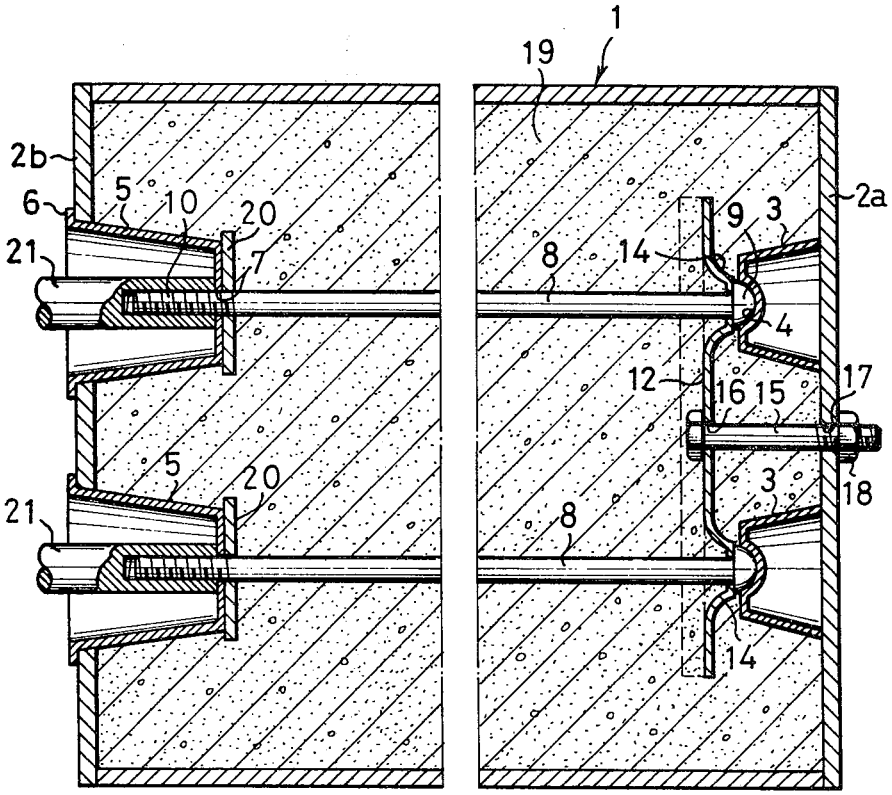
FIG. 1 is a cross-sectional view showing concrete placed in a mold, in which a tensioning steel member is placed.

Referring now to drawings, shown at 1 is a mold which is formed to a box shape having an open top surface and has an inverted trapezoid shape in its cross section. The mold is made of iron plates and synthetic resin plates. Shown at 2*a* and 2*b* are mold panels opposing to each other in the direction of a stress being introduced. Provided on the inner surface of mold panel 2*a* in given positions are fixing metal pieces 3 of a frustoconical shape which projects from the inner surface of the panel 2*a*. The top surface of the fixing metal piece 3 is formed with a concave portion 4. Provided on the inner surface of the other mold panel 2*b* in the positions corresponding to the fixing metal pieces 3 are guide metal pieces 5 which are of a frustoconical shape, having closed top and open bottom. The guide metal piece 5 is inserted through a through-hole in the mold panel 2*b* for attachment from outside, with its flange portion engaging the periphery of the through-hole. On the other hand, there is provided an inserting hole 7 in the top surface of the guide metal piece 5 for admitting a tensioning steel member therethrough.

The tensioning steel member 8 to be placed in the mold 1 is formed with a head portion 9 at its one end and with a threaded portion 10 at the other end thereof, with the mid portion thereof coated with a sliding material 11 thereon. The sliding member has a top surface of a non-sticky layer 11a and sticky layers 11b thereunder, so that the sliding member will not stick to any other members in assembling a mold as well as in placing steel bars and concrete in the mold, thus preventing peeling between the concrete and the other members, while insulating concrete from the tensioning steel member 8.

The coating method of sliding material 11 on the tensioning steel member 8 is such that a sticky material such as water glass, asphalt, other high molecular material and a synthetic resin similar thereto is applied to the outer circumference of a steel bar and then a hardener is applied thereon, or the top surface of a coating is hardened by a known hardening method, thereby rendering the top surface of the coating in non-sticky condition.

The following examples will be given so as to describe the above method in more detail.

EXAMPLE 1

In case water glass is used as a sliding material, carbon dioxide gas, sodium aluminate or cement may be used for rendering the surface of the coating of a sliding material in non-sticky condition.

EXAMPLE 2

In case an asphalt emulsion is used as a sliding material, the top surface of the asphalt emulsion is rendered in non-sticky condition by using asphalt decomposing agent, for instance, a different kind of a emulsion, such as anion emulsion for a cation emulsion, or fly ash, talc powder, cement and the like.

EXAMPLE 3

In case a synthetic resin is used as a sliding material, either one of two-liquid-reactive-type-synthetic-resins are used, while the top surface of the coating of one resin is slightly coated with the other resin, thereby rendering the top surface of the coating in non-sticky condition.

Figure 2:
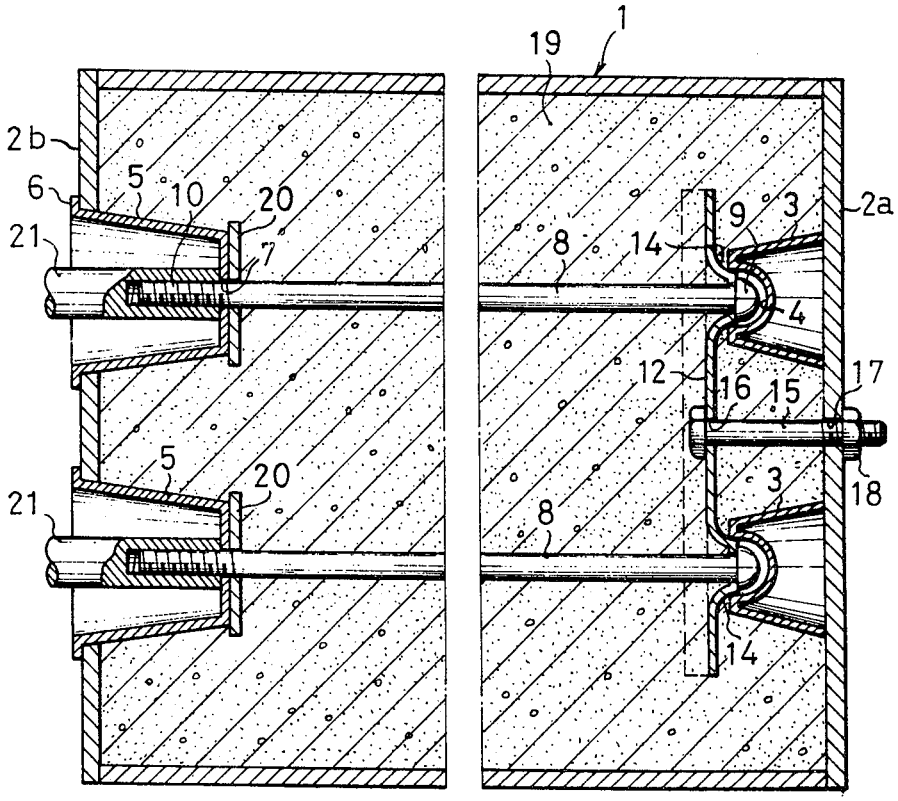
FIG. 2 is a cross-sectional view of another embodiment of the mold filled with concrete therein, with a tensioning steel member placed therein beforehand.
Figure 3:
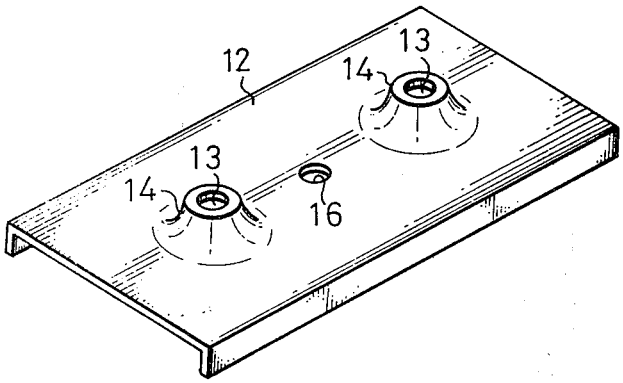
FIG. 3 is a perspective view of one embodiment of an anchor plate used in a device according to the present invention.
Figure 4:
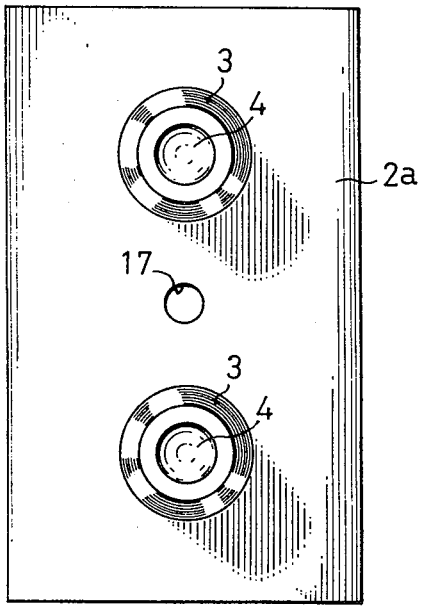
FIG. 4 is a front view of the inner surface of a mold panel.
Figure 5:
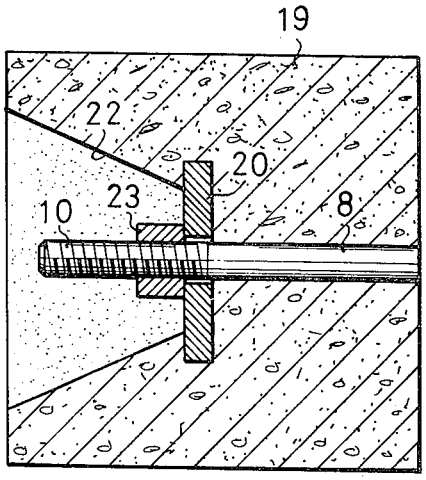
FIG. 5 is an enlarged view, partly broken, of a tensioning steel fastening member for use with a concrete member, to which a prestress has been introduced.
Figure 6:
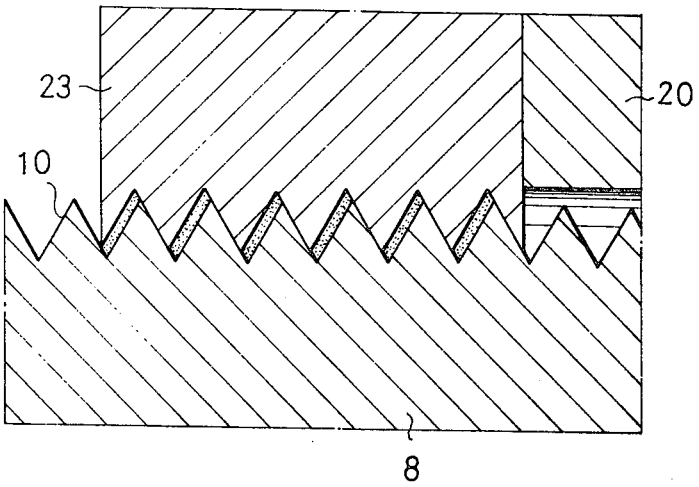
FIG. 6 is an enlarged view of thread portions of the tensioning steel member and a fastening nut in meshing relation.

An anchor plate 12 is secured to the tensioning steel member 8 thus prepared. The form of the anchor plate may be flat, as far as the thickness of the plate 12 is sufficiently large so that the anchor plate 12 may withstand the tension acting on the tensioning steel member 8. However, in case the thickness of the anchor plate 12 is smaller, the plate may assume a channel form as shown in FIG. 2, while the peripheral portion of a through-hole 13 for the tensioning steel member is drawn so as to project outwardly, i.e., to a crater shape having a hyperbolic shape, thus forming a projecting portion 14. The tensioning steel member 8 is inserted through the through-hole 13 and then the anchor plate 12 is fixed due to engagement with the head portion 9.

Subsequently, the threaded portion 10 of the tensioning steel member 8 is inserted through the through-hole 7 into the guide metal piece 5, with the head portion 9 fitted in the concave portion 4 of the fixing metal piece 3, while a bolt 15 is inserted through a bolt inserting hole 16 in the anchor plate 12 and then the threaded end portion of the bolt 15 is inserted through a bolt inserting hole 17 provided in the mold panel 2, after which a nut 18 is threaded on the aforesaid threaded end to fasten the anchor plate 12 to the panel 2*a* by means of the bolt 15. As a result, the tensioning steel member 8 is positively held in a given position due to the head portion 9 being sandwiched between the fixing metal piece 3 and the anchor plate 12. The anchor plate 12 may be fixed without any displacement during the pouring operation of concrete 19.

With the alternative arrangment as shown in FIG. 2, the projecting portion 14 of the anchor plate 12 is fitted into the convex portion of the fixing metal piece 3, thereby achieving the function similar to that mentioned above.

An anchor metal piece 20 is fitted on the root of the threaded portion 10 which is to be inserted in the guide metal piece beforehand, and then the threaded portion 10 is inserted, while the anchor metal piece 20 is kept in contact with the top or innermost end of the guide metal piece 5 by using a steel wire or the like.

Then, a tensioning rod 21 is threaded on the threaded portion 10 projecting in the guide metal piece 5 to tighten the tensioning steel member 8, after which concrete 19 is placed in the mold 1.

After the concrete 19 has been hardened or cured, the mold 1 is dismantled and the mold panels 2*a*, 2*b* are removed together with the fixing metal pieces 3 and guide metal pieces 5.

When the guide metal pieces 5 are thus withdrawn, then concave portions 22 are formed thereat. Adhesive such as an epoxy resin is applied to the threaded portion 10 of the tensioning steel member 8 projecting within the concave portion 22, after which a hardener is applied to the female thread portion of the tightening nut, and then the nut 23 is threaded on the threaded portion 10 of the tensioning steel member 8. Then, the tensioning rod 21 is threaded thereon to apply a tension to the tensioning steel member 8, and then the steel member 8 is tightened with the tightening nut 23, thereby introducing a prestress to the concrete 17.

In case the adhesive is of a epoxy resin, polyamine, polyamid or acid anhydride is used as a hardener.

Conversely, a hardener may be applied to the tensioning steel member 8, while the adhesive is applied to the tightening nut 22. Meanwhile, the adhesive and hardener are mixed, before application, so as to give the same volume, while the hardening times required are also adjusted, by adding extending agents thereto.

The adhesive and hardener contact each other through voids or gaps defined between the threaded portion 10 and the female thread portion of the tightening nut 23 which are under tension, and fill in the voids. In this condition, the adhesive is then hardened, so that the tightening nut 23 will not be loosened and thus fixed rigidly and positively.

Finally, the fixing metal pieces 3 are removed, and then mortal or concrete is filled in a concave portion left by withdrawing the fixing metal piece in this manner.

Meanwhile, in this embodiment, the anchor plate 12 is secured to two tensioning steel members 8. However, if the spacing between the tensioning steel members, 8, 8 is considerably great, then anchor metal pieces may be secured to the steel members 8, 8, respectively or independently, and then may be fastened with bolts.

Figure 7:
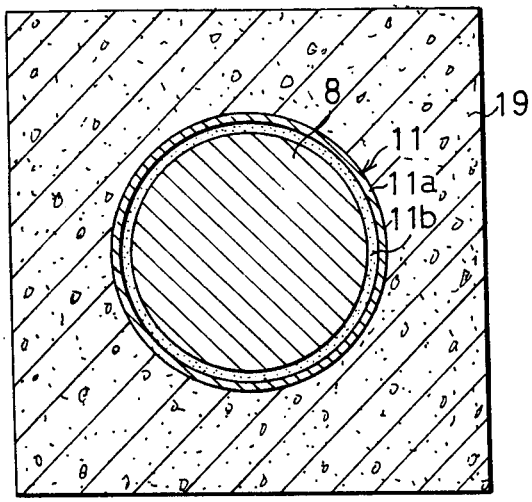
FIG. 7 is an enlarged view of a tensioning steel member buried in concrete.
Figure 8:
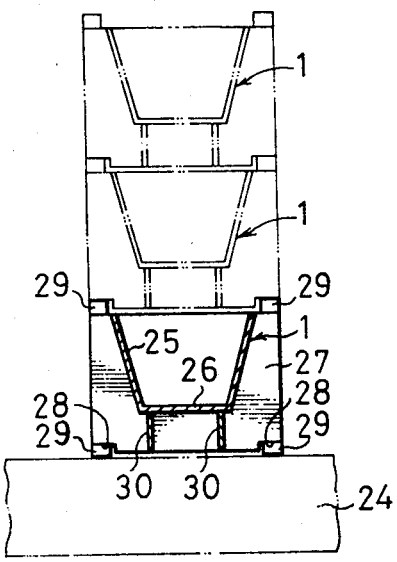
FIG. 8 is a cross-sectional view showing a stacked condition of mold according to the present invention.

In addition, when practicing the present invention, the molds 1 may be stacked one on top of another on a base board 24 as shown in FIG. 7, thereby utilizing the space efficiently. In this respect, there are provided in two positions supporting plates integral with side panels 25 and a bottom panel 26 of the mold 1 in a manner to surround the panels 25 and 26 but extending in the transverse direction of the mold. In addition, there are provided cut-away portions in the lower opposite corners of the supporting plate 27. Standard horizontal supports 29 are located so as to be positioned in the cut-away portions 28. In addition, there are provided two reinforcing ribs 30 extending perpendicular to the bottom panel. Thus, supporting plates 27 are placed on the standard horizontal supports 29 on the base board 24, and then the lowermost stage of a mold is set up on the four standard horizontal supports 29, after which another mold is stacked on the lowermost mold 1 in the manner similar to that of the lowermost mold 1, thus repeating the same procedure to stack several molds one on top of another.

According to this arrangement, the space of the molds may be utilized efficiently. In addition, even if the molds 1 are subjected to distortion after the concrete has been filled in the molds 1, the shapes of the molds may be restored to the original shapes due to the gravities of the concrete and molds 1, presenting concrete members of a high accuracy.

What is claimed is:

1. A device for producing a prestressed concrete member, comprising:

a mold including a first panel having at least one fixing metal piece projecting inwardly from the inner surface thereof, said fixing metal piece being substantially cup-shaped and having a concave portion in the innermost surface thereof, a second panel having at least one opening therein and having at least one guide metal piece disposed in said opening and extending inwardly therefrom, said guide metal piece being substantially cup-shaped and having a hole therein, the open end of said guide metal piece facing outwardly, at least one tensioning steel member, said first and said second panels being arranged in opposing relation, said tensioning steel member having one end provided with an upset head portion, an anchor plate engaging the side opposite the free end of said head portion and being spaced from and fastened to said first panel, said head portion engaging said innermost surface of said fixing metal piece, and the end of said tensioning steel member opposite said head portion having a threaded portion extending into said guide piece through said hole in said guide piece, and a nut member threaded on said threaded portion.

2. A device as set forth in claim 1, wherein said anchor plate has at least one projecting portion in the form of a crater, each said projecting portion projecting from one surface of said anchor plate, said projecting portion having said tensioning steel member extending therethrough, said upset head portion being engaged with one of said projecting portion.

3. A device as set forth in claim 1, wherein said anchor plate has said tensioning steel member extending therethrough, said upset head portion being fitted in said concave portion.

4. A device as set forth in claim 2, wherein said projecting portion of said anchor plate is fitted in the concave portion of said fixing metal piece.

5. A device as set forth in claim 1, wherein said mold consists of said two panels and side panels and a bottom panel to form a box shape; two supporting plates are provided spaced from each other and engaging said side panels and said bottom panel so as to support said mold, said supporting plates extending in the transverse direction of said mold, said supporting plates each having cut-away portions on the lower opposite corners thereof; and standard horizontal supports being located at the lower opposite corners of said supporting plates so as to be positioned in said cut-away portions, respectively.

6. A device as set forth in claim 1, wherein said tensioning steel member has a sliding material coated therearound, covering at least a part of said steel member, said sliding material including an inner layer of a sticky material, and said sliding material further including an outer layer of non-sticky material.

7. A device as set forth in claim 6, wherein said inner layer is made of water glass, and said outer layer is water glass that has been hardened by exposure to carbon dioxide gas.

8. A device as set forth in claim 6, wherein said inner layer is made of water glass, and said outer layer is water glass that has been hardened by exposure to sodium aluminate.

9. A device as set forth in claim 6, wherein said inner layer is made of water glass, and said outer layer is water glass that has been hardened by exposure to cement.

10. A device as set forth in claim 6, wherein said inner layer is an asphalt emulsion, and said outer layer is asphalt emulsion that has been hardened by exposure to fly ash.

11. A device as set forth in claim 6, wherein said inner layer is an asphalt emulsion, and said outer layer is asphalt emulsion that has been hardened by exposure to talc powder.

12. A device as set forth in claim 6, wherein said inner layer is an asphalt emulsion, and said outer layer is asphalt emulsion that has been hardened by exposure to cement.

13. A device as set forth in claim 6, wherein said inner layer is a liquid-reactive-type-synthetic resin, and said outer layer is a liquid-reactive-type-synthetic resin.

* * * * *